US011156399B2

(12) United States Patent
Staud et al.

(10) Patent No.: US 11,156,399 B2
(45) Date of Patent: Oct. 26, 2021

(54) SHELF WITH THREE-SIDED CARRIER FRAME

(71) Applicant: BSH Hausgeraete GmbH, Munich (DE)

(72) Inventors: Ralph Staud, Munich (DE); Thomas Tischer, Haar (DE); Volkan Cakirca, Istanbul (TR); Oezkan Dagci, Tekirdag (TR); Caner Kara, Tekirdag (TR); Fidan Gueler, Istanbul (TR); Oezguer Uysal, Istanbul (TR)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 16/999,335

(22) Filed: Aug. 21, 2020

(65) Prior Publication Data

US 2021/0055040 A1 Feb. 25, 2021

(30) Foreign Application Priority Data

Aug. 21, 2019 (TR) ..... 2019/12525

(51) Int. Cl.
*F25D 25/02* (2006.01)
*F25D 11/00* (2006.01)

(52) U.S. Cl.
CPC ..... *F25D 25/02* (2013.01); *F25D 11/00* (2013.01); *F25D 2325/022* (2013.01)

(58) Field of Classification Search
CPC ..... F25D 25/02; F25D 2325/022; F25D 2325/021; F25D 25/024; F25D 23/067; A47B 96/025; A47B 2210/175; A47B 96/027; A47B 96/062
USPC ..... 108/17, 63, 76, 86, 102, 106–108, 138, 108/143; 312/404, 408, 410, 301, 351
See application file for complete search history.

(56) References Cited

U.S. PATENT DOCUMENTS

| | | | | |
|---|---|---|---|---|
| 2,262,578 A | | 11/1941 | Ellis | |
| 2,319,470 A | | 5/1943 | Nobles | |
| 3,264,049 A | * | 8/1966 | Peterson | F25D 25/02 312/304 |
| 4,736,997 A | * | 4/1988 | Besore | A47F 5/005 108/108 |
| 8,881,660 B2 | * | 11/2014 | Simpson | F25D 1/00 108/108 |
| 10,648,724 B2 | * | 5/2020 | Quinlan | F25D 25/02 |

(Continued)

FOREIGN PATENT DOCUMENTS

| | | |
|---|---|---|
| CN | 203036995 U | 7/2013 |
| CN | 103575045 A | 2/2014 |

(Continued)

*Primary Examiner* — Hiwot E Tefera
(74) *Attorney, Agent, or Firm* — Laurence A. Greenberg; Werner H. Stemer; Ralph E. Locher

(57) ABSTRACT

A shelf for a household refrigeration appliance has a shelf plate, which has a first plate element and a separate second plate element, which is arranged next to the first plate element in a use position in the widthwise direction of the shelf to form the a continuous shelf plate and which can be removed non-destructively to make the shelf plate smaller. The shelf further has a carrier frame, which only borders the edges of the shelf plate. The carrier frame is only configured around three sides of the shelf plate and has a rear frame element and two opposing side frame elements.

14 Claims, 15 Drawing Sheets

(56) References Cited

U.S. PATENT DOCUMENTS

| | | | | |
|---|---|---|---|---|
| 2003/0020387 | A1* | 1/2003 | Wing | A47B 96/067 312/408 |
| 2011/0001415 | A1* | 1/2011 | Park | F25D 25/02 312/408 |
| 2012/0091084 | A1* | 4/2012 | Amaral | F25D 25/024 211/80 |
| 2013/0020922 | A1* | 1/2013 | Jang | F25D 23/067 312/408 |
| 2014/0239792 | A1* | 8/2014 | Chellappan | A47B 96/025 312/408 |
| 2014/0265803 | A1* | 9/2014 | Kelly | F25D 23/00 312/404 |

FOREIGN PATENT DOCUMENTS

| | | | |
|---|---|---|---|
| DE | 102018220657 | A1 | 7/2019 |
| EP | 2749829 | A2 | 7/2014 |
| WO | 2008122525 | A1 | 10/2008 |
| WO | 2015007607 | A1 | 1/2015 |

* cited by examiner

SHELF WITH THREE-SIDED CARRIER FRAME

CROSS-REFERENCE TO RELATED APPLICATION

This application claims the priority, under 35 U.S.C. § 119, of Turkish application TR 2019/12525, filed Aug. 21, 2019; the prior application is herewith incorporated by reference in its entirety.

BACKGROUND OF THE INVENTION

Field of the Invention

One aspect of the invention relates to a shelf for a household refrigeration appliance, with a shelf plate, which has a first plate element and a separate second plate element, which is arranged next to the first plate element in the widthwise direction of the shelf in a use position to form the shelf plate. The second plate element can be removed non-destructively to make the shelf plate smaller.

Such a shelf is known from international patent disclosure WO 2015/007607 A1. Here two plate elements are arranged next to one another in the same position in a heightwise direction and a depthwise direction without overlap in the use state, in which items being stored can be positioned on the plate elements. The shelf has just one rear frame element, on which both plate elements are held. A grip element that can be displaced in a widthwise direction is arranged at the front.

A storage rack for refrigerated items is known from international disclosure WO 2008/122525 A2. The rack has a frame that is closed all around. Two separate plate elements are arranged on the frame. One of the plate elements can be displaced on the frame in a widthwise direction, being pushed over the other plate element. Both plate elements are arranged next to one another in the use state when viewed in the widthwise direction.

A shelf is also known from published, European patent application EP 2 749 829 A2, with which two separate plate elements are arranged one behind the other rather than next to one another. The plate elements are connected using a pivot apparatus, so that the front plate element can be pivoted up onto the rear plate element.

BRIEF SUMMARY OF THE INVENTION

It is the object of the present invention to create a shelf, with which plate elements that can be positioned next to one another in a widthwise direction are arranged in a more stable manner in the use position but it is still possible to remove one plate element from the use position on the carrier frame easily and completely.

This object is achieved by a shelf, having the features set out in the independent claim.

One aspect of the invention relates to a shelf for a household refrigeration appliance, with a shelf plate, which has a first plate element and a separate second plate element, which is arranged next to the first plate element in the widthwise direction of the shelf in a use position to form the continuous shelf plate or storage surface. The second plate element can be removed non-destructively to make the shelf plate smaller. The shelf has a carrier frame, which only borders parts of the edge of the shelf plate. The carrier frame is only configured around three sides of the shelf plate. The carrier frame has a rear frame element and two opposing side frame elements. The plate elements can thus be held in a stable manner in the use position. However a plate element can still be removed easily and completely from its use position in the carrier frame, as it can be accessed and handled easily via the side on which there is no carrier frame present. The carrier frame is in particular open at the front. This allows a plate element to be removed easily and completely in a forward direction. The shelf can also be referred to as a compartment base.

The rear frame element and the side frame elements are preferably separate components. They are connected to one another in a releasable manner, in particular by means of plug-type connections and by use of screw connections. This allows the individual components of the carrier frames to be produced more easily but they are still coupled in a mechanically stable and resilient manner. Two different types of mechanical connection in particular allow the only three-sided carrier frame to support a significant load and achieve a high level of torsional strength.

An upper grooved holder is preferably configured in the rear frame element. A rear edge of the first plate element is inserted into this upper grooved holder. At least one side frame element can additionally or alternatively have an upwardly open bearing platform, on which the first plate element rests. This allows the plate element to be held securely, while not restricting the upper bearing surface. The first plate element is also held securely to the rear, in particular in a number of spatial directions.

A side frame element preferably has a side stop, against which a side edge of a plate element rests. This creates a filigree side contour or a side web, which predefines an end position of the plate element in a widthwise direction. The side stop is in particular just a vertically oriented low wall. In particular the height of the side stop is less than or equal to the height or thickness of the plate element. This avoids unwanted upward protrusions and restrictions of the bearing surface of the plate element.

The rear frame element and a side frame element preferably comprise a stowage unit of the shelf. In particular the stowage unit is integrated in the carrier frame or configured as a single piece therewith. In a non-use state the second plate element can be stowed on or in the stowage unit below the first plate element on the shelf itself. This means that the plate element that is not required remains on the shelf and does not have to be stowed elsewhere. This in particular allows space-saving stowage.

In particular the rear frame element has an integrated holding groove for the stowage unit and the side frame element has an integrated holding groove for the stowage unit. This creates an embodiment with which the second plate element is held on two different edges or side edges in the non-use position or non-use state. A secure stowage position is thus achieved while the stowage unit remains very compact and configured on the frame alone.

The rear frame element preferably has a separating web oriented in the direction of the longitudinal axis of the rear frame element. The separating web in particular separates an upper grooved holder of the rear frame element from a holding groove for a stowage unit of the shelf configured below it in a heightwise direction. The holding groove, which is separate from the grooved holder, is configured in the rear frame element. The separating web increases the stability of the rear frame element, despite being embodied with two grooves. The separating web also delimits the two grooves. The separating web is therefore multifunctional and is integrated in the rear frame element or configured as a single piece therewith.

An upper wall of the separating web preferably forms a lower boundary wall of the grooved holder in the depthwise direction of the shelf. As a result the grooved holder is delimited downward in a stable manner and has a high load-bearing capacity. In particular the lower boundary wall is larger, when viewed in a depthwise direction, than an upper boundary wall of the grooved holder. This allows easy insertion of a plate element into the grooved holder. The longer lower boundary wall means that the plate element can first be positioned thereon from above then pushed rearward into the grooved holder. A larger surface of the plate element then lies on the lower boundary wall even in the inserted end state. In particular a lower wall of the separating web can additionally or alternatively form an upper boundary wall of the holding groove. This lower wall of the separating web is larger, when viewed in a depthwise direction, than a lower boundary wall of the holding groove configured below it. This means that the second plate element is covered and protected more by the lower wall in the non-use position.

The lower wall of the separating web preferably has a straight rear segment and a second, front segment that rises obliquely upward and forward. The two segments are directly adjacent, when viewed in a depthwise direction. In this embodiment the entry opening of the holding groove for the stowage unit, which is open at the front, is widened in a heightwise direction. This simplifies the insertion and removal of the second plate element.

The upper wall of the separating web preferably has a channel-like surface offset running in the widthwise direction of the shelf, at least in the segment in which the removable second plate element can be positioned. This surface offset is configured at a point where the upper boundary wall of the grooved holder has its front edge, when viewed in the depthwise direction of the shelf. The surface offset therefore widens the grooved holder in a heightwise direction at its entry opening. This allows easier insertion and removal of a plate element, in particular the second plate element. The surface offset is configured in particular as a step, at which a ramp, which inclines obliquely downward and rearward, opens out from the front.

The separating web is preferably configured as a hollow profile. This reduces its weight. The hollow space can also be used to hold further elements. In particular at least one screw dome is configured in the hollow space, at least for screwing to another component. Provision can be made in particular for the rear frame element to be screwed to the side frame elements with this. The at least one screw dome is preferably configured as a single piece with the separating web. It is thus configured so that it is integrated in the separating web.

A front end region of an upper boundary wall of the grooved holder preferably has an angled inner wall, thereby enlarging the vertical clearance of the grooved holder. This allows easier insertion and removal of a plate element. Such a configuration is in particular only used for the side frame element, on which the second plate element is arranged in its use position.

When viewed over the entire width of the second plate element measured in a widthwise direction, the grooved holder preferably has a depth measured in a depthwise direction, which is greater than a distance, measured in a depthwise direction, between a pull-out stop or a stop edge and a front edge of an edge protection element. The edge protection element is arranged on a rear edge of the second plate element. In particular it has a U-shaped profile in cross section. A lower U-arm in a heightwise direction has a front edge. This in particular is the edge from which the distance to the pull-out stop is measured. The distance is measured with the second plate element in the end position on the carrier frame and with the second plate element in the use position. The pull-out stop is configured on the side frame element, on which the second plate element is positioned in the use position. This advantageous embodiment prevents the second plate element dropping down when it is pulled forward out of the end position. Its front edge therefore strikes the pull-out stop, before the edge protection element and/or the rear edge of the second plate element can be pulled out of the grooved holder completely.

The shelf preferably has a securing element, which is arranged on a front edge of the second plate element, in particular in a fixed position. This means in particular that the securing element cannot be displaced relative to the second plate element either in a depthwise direction or in a widthwise direction. It is therefore arranged permanently thereon in a stable position and accurately located. The securing element projects beyond the second plate element in a widthwise direction. When the two plate elements are in the use position, a segment of the securing element engages around a front edge of the first plate element. The two plate elements are therefore held at the same height at the front. In particular the segment of the securing element, which is provided to engage around the front edge of the first plate element, is configured as a hollow channel. The front edge of the first plate element projects into this when the second plate element is in the use position. However the segment presents no clamping or clipping of the front edge. It is simply configured as a sleeve. It is possible to draw the second front edge out of the segment without overcoming a clamping or clipping force acting in a depthwise direction. The securing element can also be referred to as a height maintaining element for the plate elements in the use position.

An overlap measured in a depthwise direction between the securing element and the front edge is preferably smaller than the abovementioned depth of the grooved holder. This is the case when the second plate element is in the end position on the carrier frame and in the use position. This advantageous embodiment improves safety. It also means that when the second plate element is removed, the securing element is decoupled from the front edge of the first plate element when the second plate element is first drawn forward. It can therefore be drawn forward with the second plate element in a depthwise direction until there is no longer any overlap. In this state the front edge of the edge protection element comes up against the pull-out stop on the side frame element. In this intermediate state the second plate element can be raised or pivoted upward at the front edge. The advantageously configured, widened entry opening of the grooved holder allows it to be raised easily. In this tilted position the second plate element can then be removed completely from the grooved holder and be pulled out obliquely upward and forward.

The terms "top", "bottom", "front", "rear", "horizontal", "vertical", "depthwise direction", "widthwise direction", "heightwise direction", etc. refer to the positions and orientations resulting when the shelf is used and arranged in the correct manner.

Further features of the invention will emerge from the claims, figures and description of the figures. The features and feature combinations cited above in the description as well as the features and feature combinations cited in the following in the description of the figures and/or shown in the figures alone can be used not only in the respectively cited combination but also in other combinations, without departing from the scope of the invention. Therefore embodiments of the invention which are not specifically described and illustrated in the figures but will emerge and can be generated from the described embodiments as a result of separate feature combinations are also deemed to be covered and disclosed by the invention. Embodiments and feature combinations which do not therefore have all the features of an originally formulated independent claim should also be deemed to be disclosed. Embodiments and feature combinations, which go beyond or deviate from the feature combinations set out in the claim references, should also be deemed to be disclosed, in particular as a result of the embodiments set out above.

Other features which are considered as characteristic for the invention are set forth in the appended claims.

Although the invention is illustrated and described herein as embodied in a shelf with a three-sided carrier frame, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
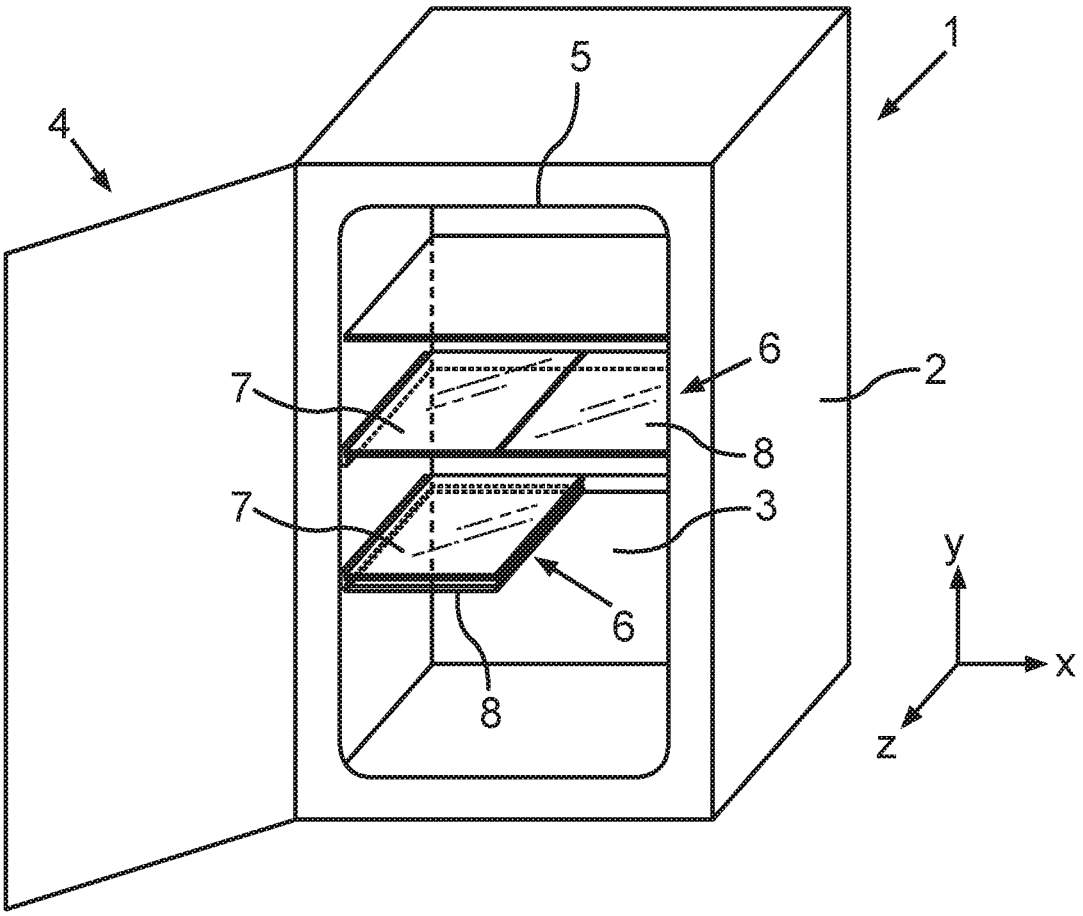
FIG. 1 is a diagrammatic, perspective view of an exemplary embodiment of a household refrigeration appliance with an exemplary embodiment of an inventive shelf.

Identical elements or those of identical function are shown with the same reference characters in the figures.

Referring now to the figures of the drawings in detail and first, particularly to FIG. 1 thereof, there is shown a perspective view of a household refrigeration appliance 1. The household refrigeration appliance 1 is configured to store and preserve food. The household refrigeration appliance 1 has a housing 2. At least one compartment 3 for holding food is configured in the housing 2. The compartment 3 can be a refrigeration compartment or a freezer compartment.

The household refrigeration appliance 1 can be a refrigerator or a freezer or a combined refrigerator/freezer appliance. The household refrigeration appliance 1 also has a door 4. The door 4 is arranged pivotably on the housing 2. It is arranged so that it closes the front of the compartment 3. The compartment 3 is delimited by walls of an inner container 5 of the household refrigeration appliance 1. In the example shelves are arranged in the compartment 3. The removable shelves can also be referred to as compartment bases. An exemplary embodiment of a shelf 6 is shown to illustrate this. In this exemplary embodiment a shelf plate is formed as a continuous surface from two separate plate elements 7, 8. Both plate elements are arranged in the use position. They are arranged next to one another here in the widthwise direction (x-direction) of the shelf 6. The widthwise direction is also that of the household refrigeration appliance 1. The two plate elements are arranged at the same height in a heightwise direction (y-direction). The heightwise direction corresponds to that of the shelf 6 and is also the same as the heightwise direction of the household refrigeration appliance 1. In their use position the two plate elements 7, 8 are also arranged at the same depth as one another in a depthwise direction (z-direction). The depthwise direction of the shelf 6 also corresponds to the depthwise direction of the household refrigeration appliance 1.

FIG. 1 also shows a corresponding shelf 6 by way of example, with only the use position of the first plate element 7 being shown. The second plate element 8 is arranged below the first plate element 7 in a heightwise direction and is positioned in a non-use position. However it remains arranged or stowed on the shelf 6 itself in this non-use position.

Figure 2:
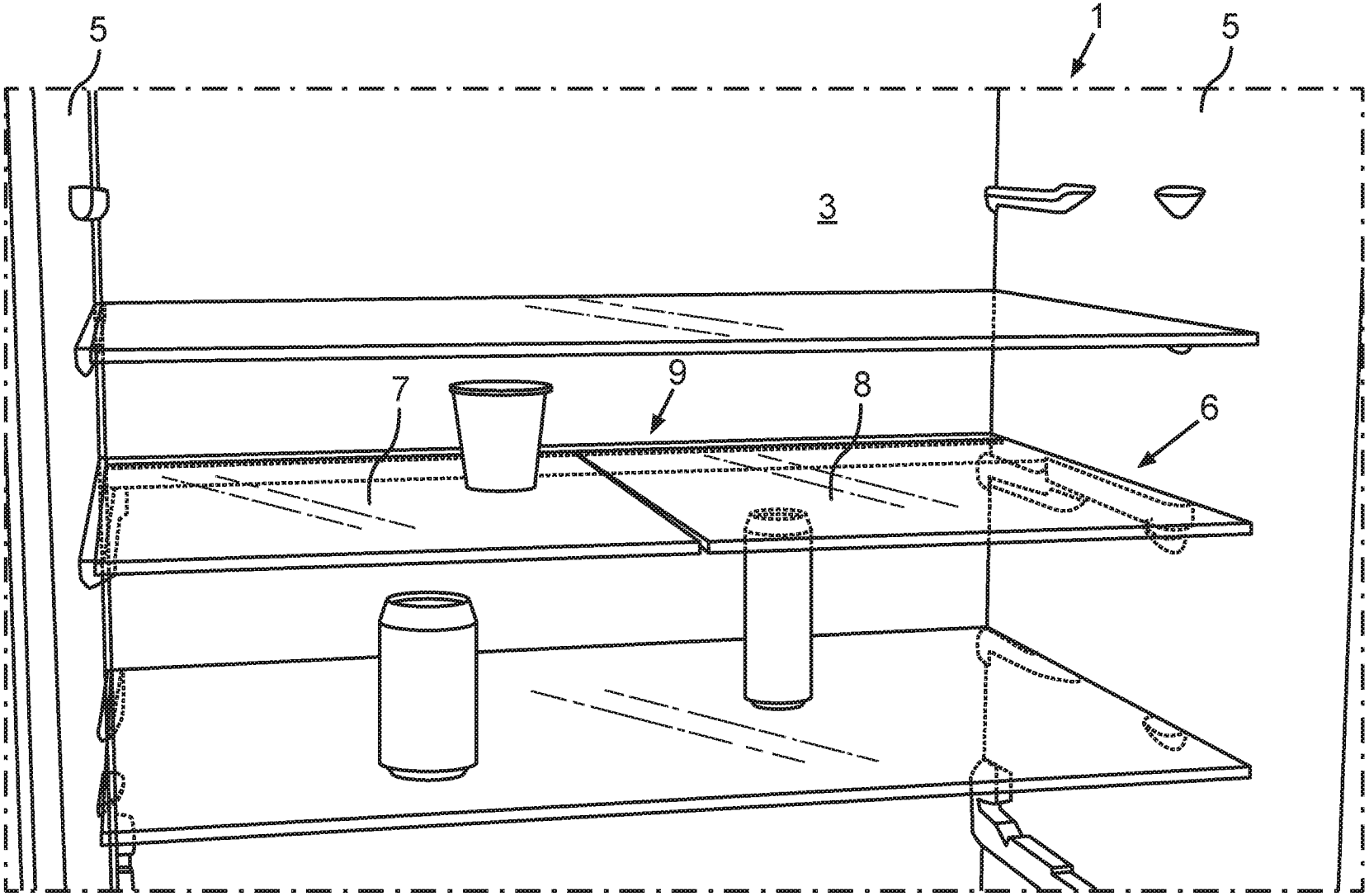
FIG. 2 is an enlarged, perspective view of an exemplary embodiment of the inventive shelf in a compartment of the household refrigeration appliance, the shelf being shown with both plate elements of a shelf plate in a use position.

FIG. 2 shows an enlarged view of a detail of the household refrigeration appliance 1. A number of compartment bases or shelves 6 are also arranged here by way of example. A shelf 6 is shown here with the two plate elements 7 and 8 in a use position. The first plate element 7 and the second plate element 8 are arranged next to one another and without overlap so that they form a common continuous horizontal and flat shelf plate 9. As shown, objects, in particular items for storage, can be placed on the shelves 6. When the entire shelf plate 9 is in the full use position according to the view in FIG. 2, objects can be placed on both plate elements 7 and 8.

Figure 3:
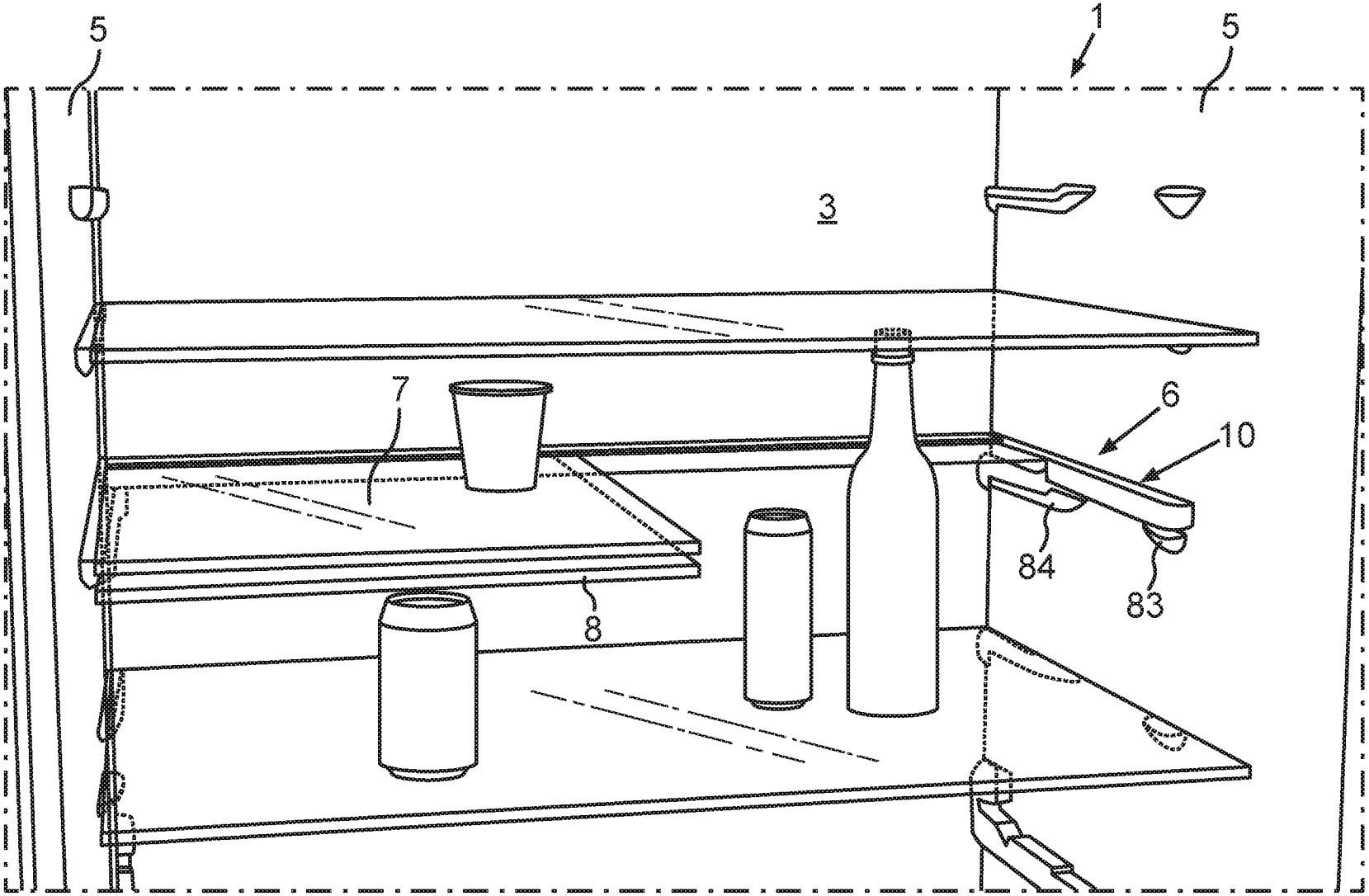
FIG. 3 is a perspective view according to FIG. 2, in which the second plate element is arranged in a non-use position.

FIG. 3 shows the shelf 6 in an arrangement, in which only the first plate element 7 is arranged in the use position. The second plate element 8 is arranged in the non-use position. To this end it is arranged below the first plate element 7 when viewed in a heightwise direction and in the same width position as the first plate element 7 when viewed in the widthwise direction and/or at the same depth position as the first plate element 7 when viewed in a depthwise direction. In particular the second plate element 8 is stowed on a carrier frame 10 of the shelf 6 in the non-use position. In this embodiment the space that becomes free in an upward direction in the region of the second plate element 8 can be used to hold larger objects, such as bottles, below the shelf 6, these then projecting further up in a heightwise direction than the shelf 6. The objects then extend upward between the two stacked plate elements 7 and 8 and the carrier frame 10.

Figure 4:
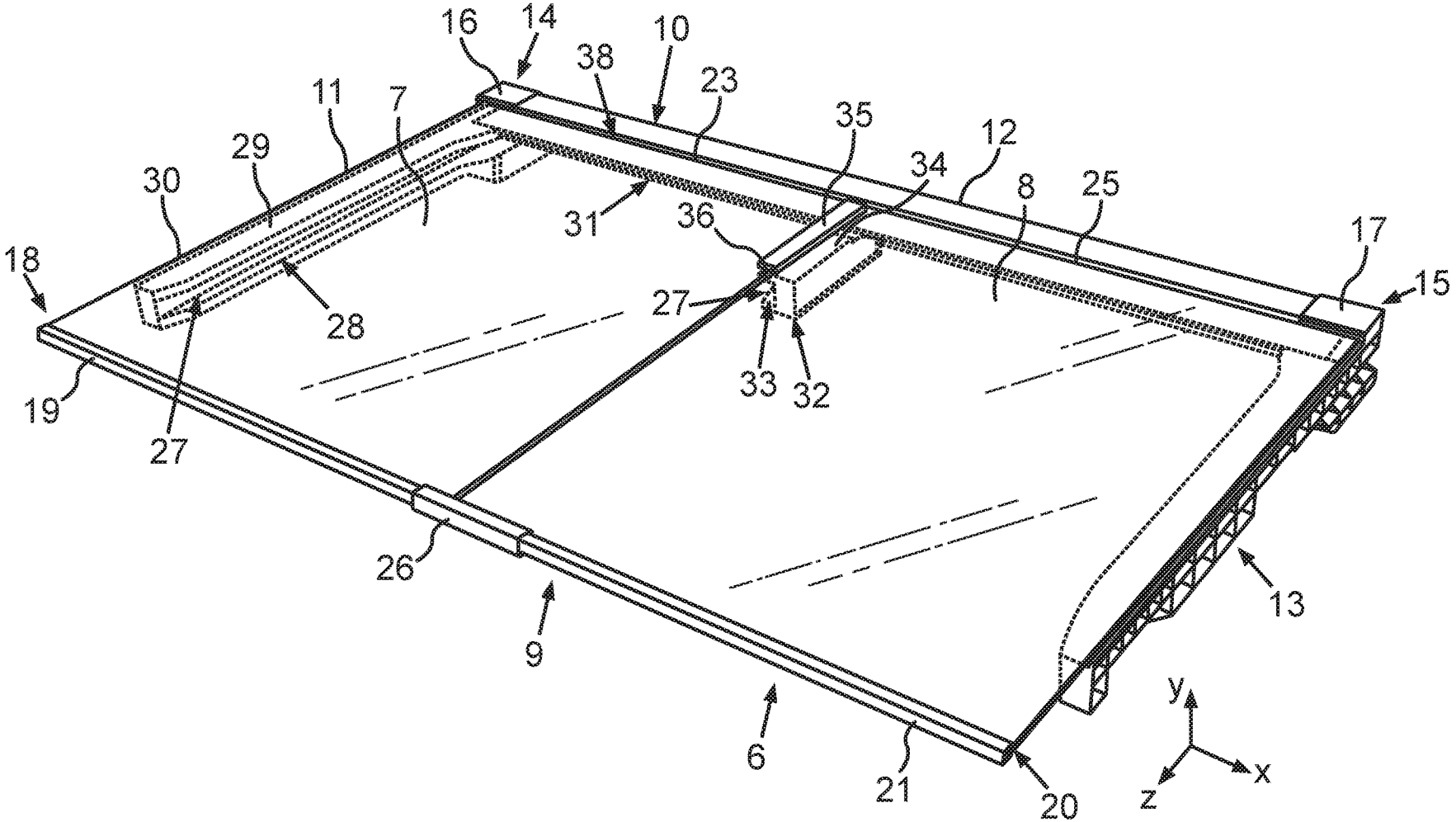
FIG. 4 is a perspective view of an exemplary embodiment of an inventive shelf with the shelf plate in the use position.

FIG. 4 shows a perspective view of an exemplary embodiment of the shelf 6. The shelf 6 contains the first plate element 7 and the separate second plate element 8. The first plate element 7 is a preferably rectangular plate. The second plate element 8 is preferably a rectangular plate. In particular the two plate elements 7 and 8 are identical in size. The first plate element 7 and/or the second plate element 8 can be made of an at least partially transparent material. They can be plastic or glass plates.

In particular the shelf 6 has the carrier frame 10 that is separate from the two separate plate elements 7 and 8. The carrier frame 10 is U-shaped. It only engages around the shelf plate 9 on three sides. The carrier frame 10 is therefore only a three-sided frame. As shown in the view in FIG. 4, the carrier frame 10 has a first side frame element 11, a rear frame element 12 and a second side frame element 13. The shelf plate 9 is not bordered by the carrier frame 10 at least at the front. The shelf plate 9 is exposed at the front.

Provision can be made for the three-sided carrier frame 10 to be configured as a single piece. This means that it is also produced as a single piece.

In one advantageous embodiment provision is made for the three frame elements 11, 12 and 13 to be separate components. They can be connected to one another by means of a respective connection, in particular a non-destructively releasable connection. Provision can be made in particular for the first frame element 11 to be connected to an end of the rear frame element 12 at its rear end in the depthwise direction (z-direction). In particular a plug-type connection and/or a screw connection can be provided here. The same provision can be made in a rear corner region of the shelf 6 between the second side frame element 13 and the rear frame element 12.

In one advantageous embodiment provision is made for the rear frame element 12 to be inserted into the first side frame element 11. The same provision can be made for the connection between the rear frame element 12 and the second side frame element 13. This results in connections that overlap in a widthwise direction between the above-mentioned frame elements 11, 12, 13 in rear corner regions 14 and 15. Provision is made in particular for an end plate 16 of the first frame element 11, which is only arranged in a corner region 14, to partially cover the rear frame element 12 from above. The same provision can be made with a cover plate 17 between the second side frame element 13 and the rear frame element 12. The cover plate 17 is only configured in a corner region 15.

FIG. 4 shows the shelf plate 9 in a full use position. This means that both plate elements 7 and 8 are arranged next to one another in a widthwise direction, in particular without overlap. They are in identical positions in a depthwise direction and in a heightwise direction, forming a continuous rectangular shelf plate 9. In particular the shelf 6 is also configured in a rectangular manner.

In one advantageous embodiment provision is made for the first plate element 7 to have a separate edge protection element 19 on a front edge 18. This is configured in particular as a U-profile and/or as a single piece. Provision can also be made for a corresponding edge protection element 21 to be arranged on a front edge 20 of the second plate element 8.

The edge protection elements 19 and 21 can be rails that are separate from the plate elements 7 and 8. They are for example attached or bonded thereto.

Figure 5:
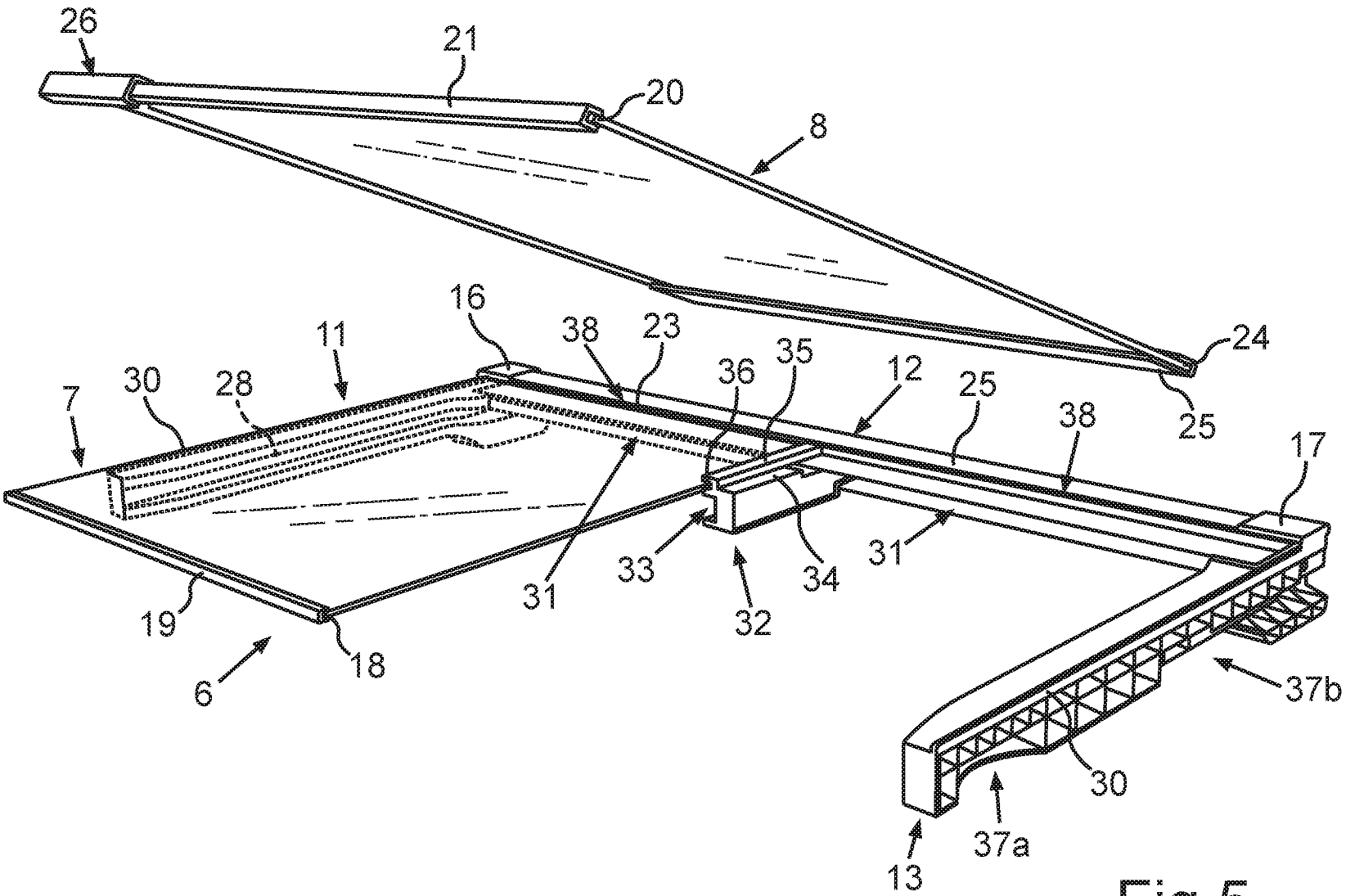
FIG. 5 is a perspective view according to FIG. 4, in which the second plate element has been removed from the use position.
Figure 7A:
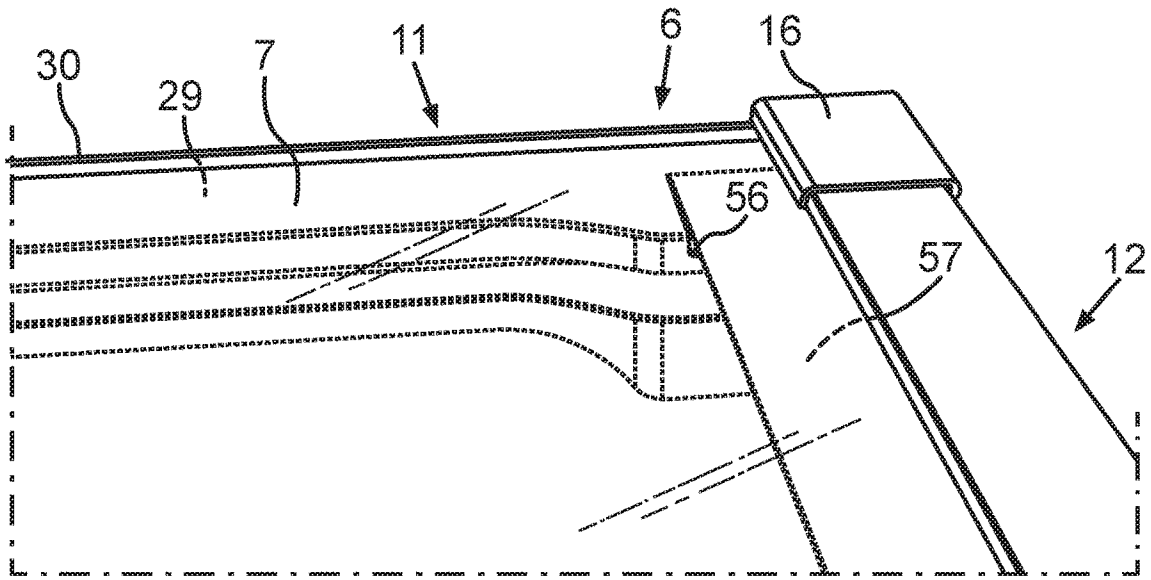
FIG. 7A is a perspective view of a rear corner region of the shelf in the region of the first plate element of the shelf plate.
Figure 7B:
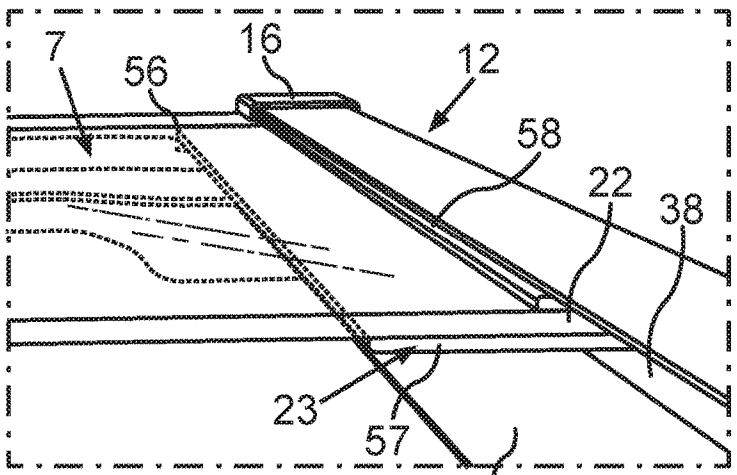
FIG. 7B is a perspective view of the components according to FIG. 7A from a different perspective.

In one advantageous embodiment provision is made for the first plate element 7 to have a separate edge protection element 23 on its rear edge 22 opposite the front edge 18 (FIG. 7B). The edge protection element 23 can be U-shaped in particular in cross section here too. Provision can also be made in particular for the second plate element 8 to have a separate edge protection element 25 at its rear end 24 (FIG. 5). The edge protection element 25 can be U-shaped.

In one advantageous embodiment the shelf 6 also has a connecting element or a front securing element 26 that is separate from the plate elements 7, 8 and the carrier frame 10. The securing element 26 is configured as a rail or bar. It engages around the front of the second plate element 8. In particular it is arranged on the second plate element 8 in such a manner that it cannot be displaced in a widthwise direction. In particular it is arranged in a fixed position thereon. For example a clamped connection or bonded connection or the like can be provided here. In particular the securing element 26 also engages around the edge protection element 21.

The securing element 26 projects laterally in a widthwise direction beyond the width of the second plate element 8 in its corner region. When the entire shelf plate 9 is in the use position shown in FIG. 4, the securing element 26 therefore also protrudes beyond a sub-region of the front edge 18 of the first plate element 7. In particular it also engages around a preferably present front edge protection 19 at the front. The securing element 26 is however not connected to the second plate element 7 in a fixed manner. It only serves as a front protective cover or protective cap for the first plate element 7. In particular there is no position-securing connection to the first plate element 7 in a widthwise direction and in a depthwise direction. The fixed arrangement of the securing element 26 on the second plate element 8, which results in a position-fixing arrangement thereon in a depthwise direction, means that the same is not brought about with the first plate element 7. The fixed positioning in a depthwise direction on the second plate element 8 means that the first plate element 7 is also held at the same level in a heightwise direction as the second plate element 8 in this arrangement according to FIG. 4. When the shelf plate 9 is in the full use position the securing element 26 therefore represents a front position or level holding element. This prevents unwanted displacement of the two plate elements 7 and 8 in a heightwise direction.

As shown in FIG. 4, the two side frame elements 11 and 13 do not extend over the entire depth of the plate elements 7 and 8. They end a distance before the front edges 18 and 20.

In one advantageous embodiment provision is made for the shelf 6 to have a stowage unit 27. The stowage unit 27 is integrated in particular in the first side frame element 11 and/or the rear frame element 12 and is therefore configured as a single piece therewith. In particular the stowage unit 27 has a holding groove 28 in the first side frame element 11. The side of the first plate element 7 is held by the first side frame element 11. The second plate element 8 is not held by it in the use position.

The holding groove 28 is configured below a bearing platform 29 of the first frame element 11 when viewed in a heightwise direction. The bearing platform 29 is open at the top. This allows the first plate element 7 to be positioned thereon from above. It is not covered laterally by the first frame element 11 in an upward direction.

The first frame element 11 also has a side stop web 30. The stop web 30 rises upward from the bearing platform 29. The stop web 30 forms a position limit or displacement stop for the first plate element 7 in a widthwise direction.

In one advantageous embodiment the stowage unit 27 also has a further holding groove 31 in the rear frame element 12. The holding groove 31 shown in FIG. 5 is open at the front. The second plate element 8 can therefore be inserted into the holding groove 28 and/or the holding groove 31 in the use position and is therefore stowed below the first plate element 7.

In one advantageous embodiment the shelf 6 has a center web 32 (FIG. 4). However the carrier frame 10 can preferably also be configured alone without the center web 32 in the embodiments cited above and also in the explanations set out below and still hold the plate elements 7, 8 in a stable manner. The center web 32 is preferably a part that is separate in particular from the carrier frame 10. The center web 32 holds the first plate element 7 on the edge region opposite the first frame element 11. The center web 32 extends in a depthwise direction. In one advantageous embodiment it is arranged directly on the rear frame element 12. The center web 32 can be a separate part from the rear frame element 12. It can be connected to the rear frame element 12 by a plug-type connection and/or a screw connection. Provision can be made for the center web 32 to be shorter, when viewed in a depthwise direction, than the two side frame elements 11 and 13. Provision can also be made for the center web 32 to be longer. The center web 32 can extend over the entire length of the two plate elements 7 and 8 measured in a depthwise direction. The center web 32 is formed as a mount or bearing part for the first plate element 7. When the second plate element 8 is in the use position, it is also arranged so that it rests on the center web 32. When the second plate element 8 is in the non-use position, in one advantageous embodiment the center web 32 also serves as a subcomponent of the stowage unit 27. To this end the center web 32 advantageously has an integrated holding groove 33. The second plate element 8 can be inserted into this and held therein in the non-use position.

In one advantageous embodiment provision can therefore be made for the stowage unit 27 to be formed by a three-sided, in particular U-shaped, holding groove. This can be formed by the three separate holding grooves 28, 31 and 33.

As shown in FIG. 4, the center web 32 has a bearing platform 34. The bearing platform 34 is configured to be open at the top. Only the second plate element 8 rests on top of the bearing platform 34 in its use position. The center web 32 also has an integrated retaining part 35. This preferably has a slot or groove 36. The edge of the first plate element 7 projects into the slot or groove 36. This is shown in FIG. 4. As shown, the engagement part 35 with the groove 36 is arranged above the preferably configured holding groove 33 when viewed in a heightwise direction.

The first plate element 7 is in particular incorporated in a fixed position on the carrier frame 10 and center web 32.

FIG. 5 shows a perspective view of the shelf 6, with the second plate element 8 removed from its use position. In FIG. 5 the second side frame element 13 is shown in a sectional view (sectional plane is the y-z plane). As shown in the views in FIG. 4 and FIG. 5, the second frame element 13 has cut-out 37*a* that is open at the bottom. A holding cam, for example cam 83, 84 (FIG. 18), arranged on a side wall of the inner container 5, can be arranged in this. Additionally or alternatively a further cut-out 38 can be configured, into which a further cam, for example cam 83 or 84 (FIG. 18), can engage on a vertical side wall of the inner container 5. This is the case when the shelf 6 is arranged in the compartment 3 and held in particular on vertical side walls of the inner container 5. The first frame element 11 can also be configured in the same way.

In particular the holding groove 31 referred to above is configured in the rear frame element 12 preferably at least over the length of the first plate element 7. It can be configured over the entire length of the rear frame element 12. This is shown in FIG. 5. As shown in the views in FIG. 4 and FIG. 5, the insides of the two side frame elements 11 and 13 are configured as a framework structure. This means they are low in weight and also extremely rigid.

Provision is made in particular for the second side frame element 13 not to have a component for the stowage unit 27. In particular it therefore has no additional holding groove, as formed by the holding groove 28.

A grooved holder 38, as shown in FIG. 4 and FIG. 5, is preferably configured to hold the first plate element 7 on the rear frame element 12. In one advantageous embodiment the grooved holder 38 is configured over the entire length of the rear frame element 12 in the widthwise direction. It therefore also serves correspondingly to hold the rear region of the second plate element 8, when the latter is arranged in the use position. The grooved holder 38 is configured above the separate holding groove 31 in a heightwise direction.

Figure 6:
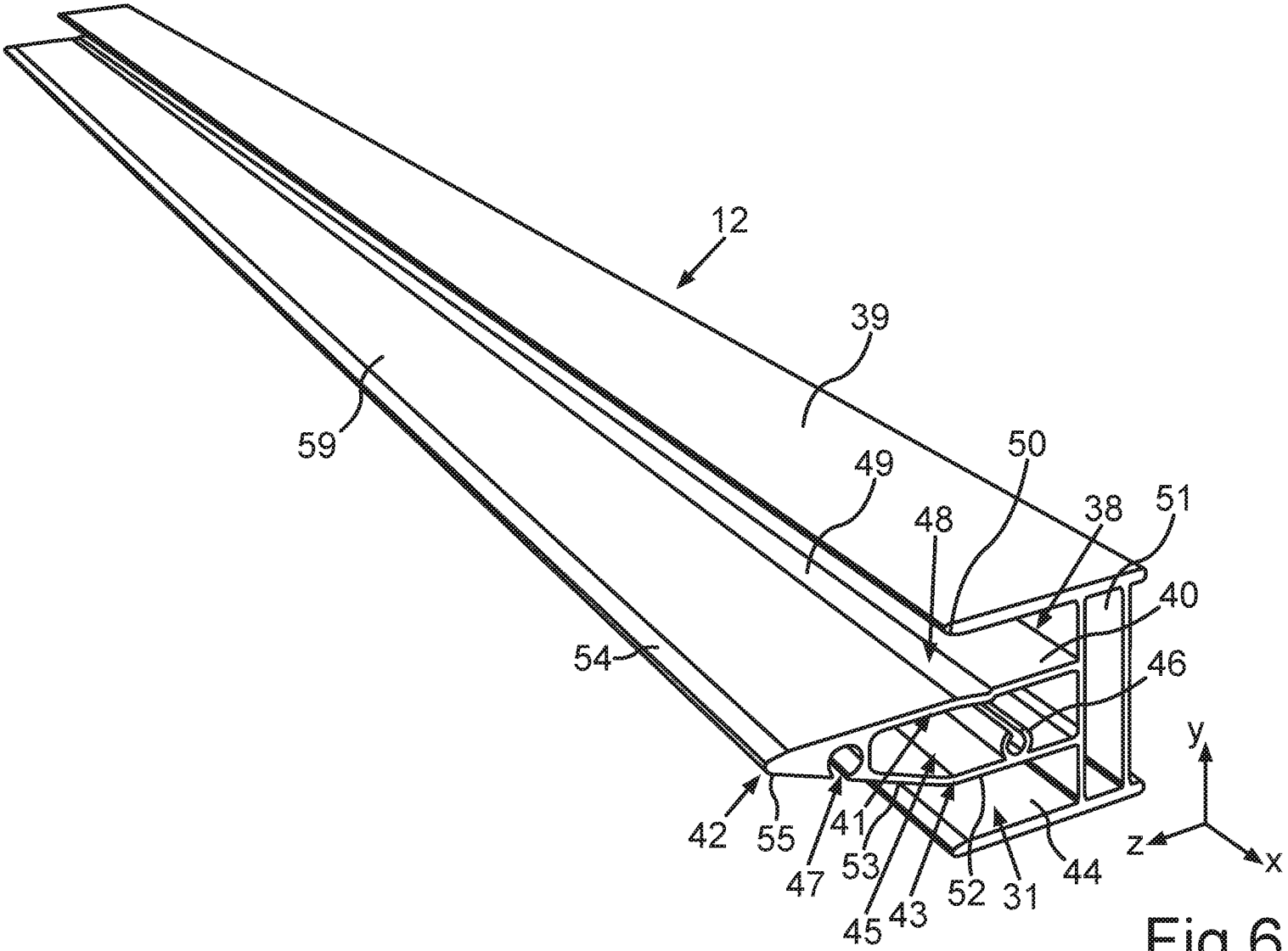
FIG. 6 is a perspective view of an exemplary embodiment of a rear frame element of a carrier frame of the shelf.

FIG. 6 shows a perspective view of the rear frame element 12. As shown, the grooved holder 38 is delimited by an upper wall 39. The grooved holder 38 is delimited by a boundary wall 40 at the bottom. The boundary wall 40 is an upper wall 41 of a separating web 42. The separating web 42 is configured as a single piece with the rear frame element 12. The separating web 42 contains the upper wall 41. It also contains a lower wall 43. The separating web 42 is preferably configured as a hollow profile. The lower wall 43 of the separating web 42 delimits the holding groove 31 at the top. The separating web 42 is therefore a partition between the grooved holder 38 and the holding groove 31 and delimits both directly. The holding groove 31 is delimited at the bottom by a lower wall or lower boundary wall 44. As shown, the separating web 42 extends further forward, when viewed in a depthwise direction, than the upper boundary wall or the upper wall 39. It therefore also extends further forward than the lower boundary wall 44.

As shown in FIG. 6, at least one screw dome 46 is integrated in a hollow space 45 in the separating web 42. In the view in FIG. 6 the second side frame element 13 can be screwed to the screw dome 46. The side of the second frame element 13 is also positioned on the structure of the rear frame element 12. A further drilled hole 47 is also integrated in a front, in particular tapered, region of the separating web 42. The drilled hole 47 is preferably configured to pass through the entire length. The separate center web 32 can be screwed to it. This also allows additional screwing of the side frame element 13 to the end of the rear frame element 12.

As also shown in FIG. 6, the upper wall 41 of the separating web 42 also has a surface offset 48. This channel-like offset 48, which is oriented in the direction of the longitudinal axis and is configured in a depthwise direction by configuring a height offset, in particular a stepped height offset, allows easier removal of the second plate element 8. In particular the surface offset 48 has an angled wall 49 oriented downward. The upper wall 39 advantageously has a bevel 50 facing the grooved holder 38 at its front end. This widens the grooved holder 38 at its front end, thereby facilitating the insertion and removal of the second plate element 8.

Provision is made in particular for the rear frame element 12 to have a hollow chamber 51, which adjoins the grooved holder 38 and the holding groove 31 as well as the separating web 42 at the rear.

As also shown in FIG. 6, the lower wall 43 of the separating web 42 is in particular not configured as straight. It has a straight rear segment 52. Adjoining this at the front is a further segment 53 oriented at an angle upward and to the front. The bevel on the one hand allows better securing of the position of the side frame element 13 and/or 11 and/or better securing of the position of the center web 32. In particular it allows easier removal and insertion of the second plate element 8 into the stowage position below the first plate element 7.

In one advantageous embodiment provision is also made for the separating web 42 to have both an upward bevel 54 and a downward bevel 55 in its front edge region. Such tapering in the taper also facilitates the insertion and removal of plate elements 7 and/or 8.

FIG. 7A shows a perspective view of a left rear corner region of the shelf 6. As shown, the bearing platform 29 has a holding trough 56. A lower arm 57 of the edge protection element 23 is embedded herein. As also shown, the position of the first plate element 7 is also secured in a depthwise direction by the end plate 16. The end plate 16 engages forward around an upper arm 58 of the edge protection element 23. As also shown in FIG. 7B, the lower arm 57 of the edge protection element 23 extends further forward than the upper arm 58.

As shown in FIG. 7B, the separating web 42 contains a bearing platform 59 in its upper wall 41. The lower arm 57 rests on this bearing platform 59. This allows better positioning and mechanically more stable arrangement of the first plate element 7.

The same applies to the second plate element 8, when it is arranged in the use position on the rear frame element 12.

Provision can also be made for the bearing platform 59 to serve as a storage region for items, in particular stored goods. This is possible particularly when the second plate element 8 is arranged in its non-use position, thereby exposing the top of the bearing platform 29 at least over the width of the second plate element 8 when viewed in a widthwise direction. Smaller items, such as yoghurt pots or the like, can be placed here for example.

Figure 8B:
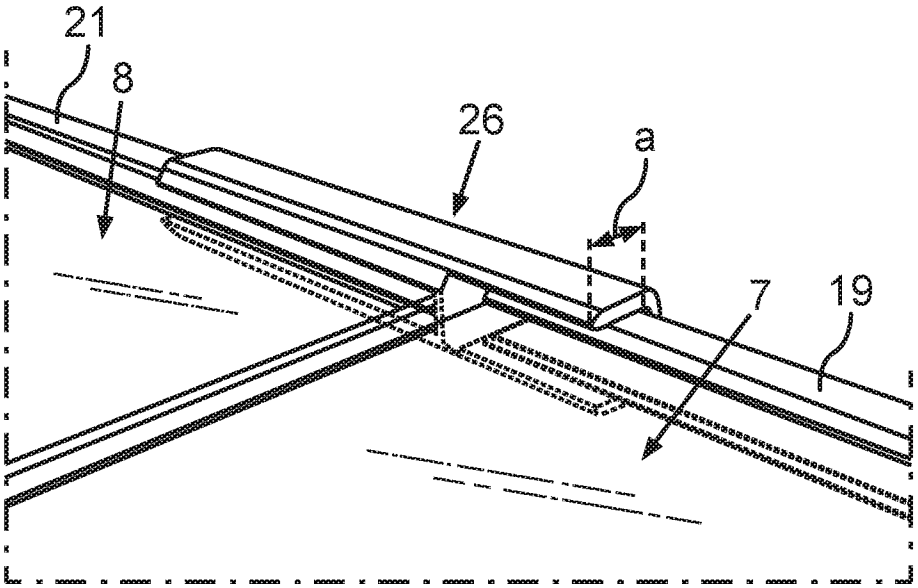
FIG. 8B is a perspective view according to FIG. 8A, also showing the first plate element of the shelf plate.
Figure 8A:
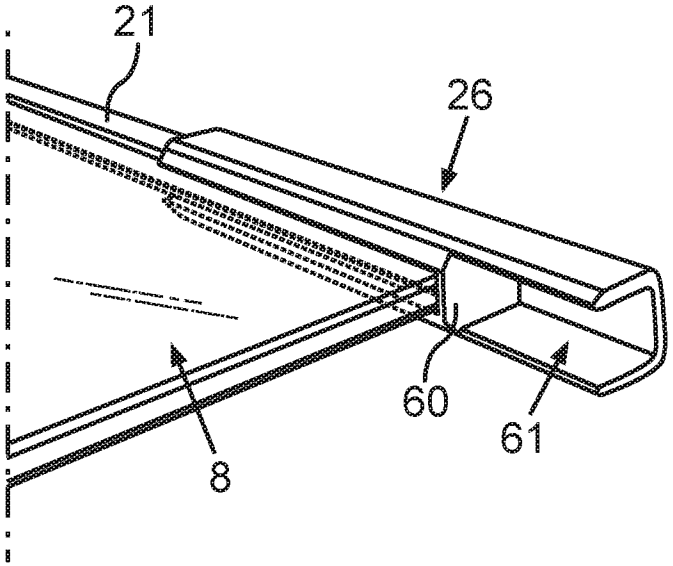
FIG. 8A is a perspective view of the second plate element in the front region with a separate securing element arranged thereon.

FIG. 8A shows a partial detail of the front region of the second plate element 8. The clamping position, in particular secured against displacement in a widthwise direction, of the securing element 26 is clearly shown. In particular the securing element 26 is configured in the manner of a brace and engages around the edge protection element 19. This prevents removal in a depthwise direction. Displacement in a widthwise direction is also prevented by a stop wall 60. As shown in the view in FIG. 8B, the securing element 26 has a hollow region 61. The hollow region 61 engages around the front corner region of the first plate element 7, as shown in FIG. 8B. This is the case when both plate elements 7 and 8 are arranged in the use position. As also shown in FIG. 8B, an overlap a measured in a depthwise direction is configured between the securing element 26 and the first plate element 7. It can also be seen that there is no clamping in the longitudinal segment of the securing element 26, which is only configured to hold the front corner regions of the first plate element 7. The front corner region of the first plate element 7 therefore simply projects into the hollow region 61, without a clamping or snap-in connection being configured.

Figure 9:
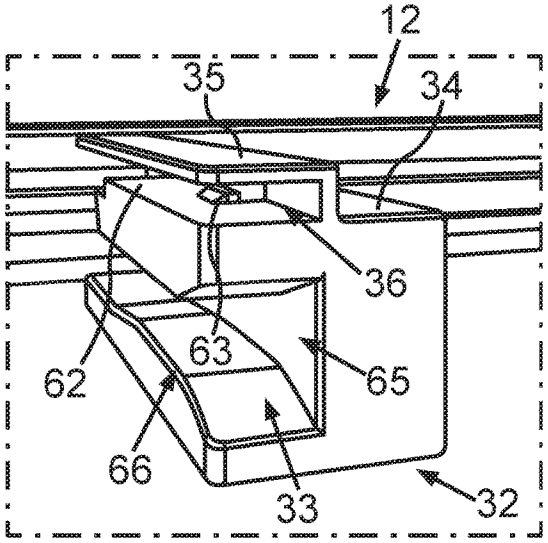
FIG. 9 is a perspective view of a center web, which is arranged between the two plate elements of the shelf plate.
Figure 11:
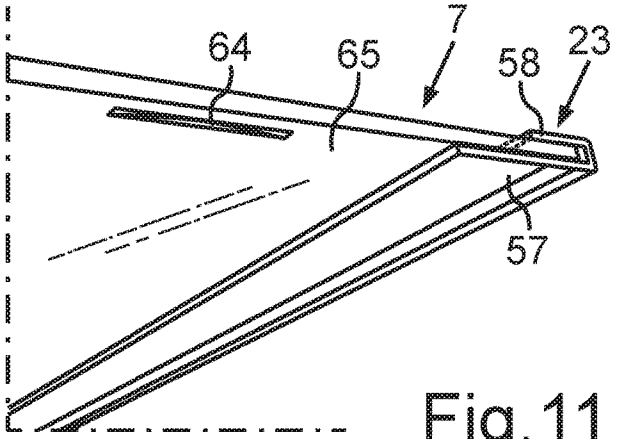
FIG. 11 is a perspective view of a sub-region of the first plate element.

FIG. 9 shows a further perspective view of the center web 32. As shown, a snap-fit element 63 is configured on a base 62 of the groove 36. It projects into the groove 36. This allows a snap-fit connection with a snap-fit holder 64, as shown in FIG. 11. The snap-fit holder 64 is configured in a lower face 65 of the first plate element 7. This improves the secured arrangement and mounting in a fixed position of the first plate element 7 in particular on the center web 32.

The snap-fit holder 64 can be for example a groove ground in the lower face 65.

FIG. 9 also shows the holding groove 33. A front groove opening 65 is widened at the top and bottom. It can also be seen that a lower boundary wall 66 of the holding groove 33 is uneven.

Figure 10:
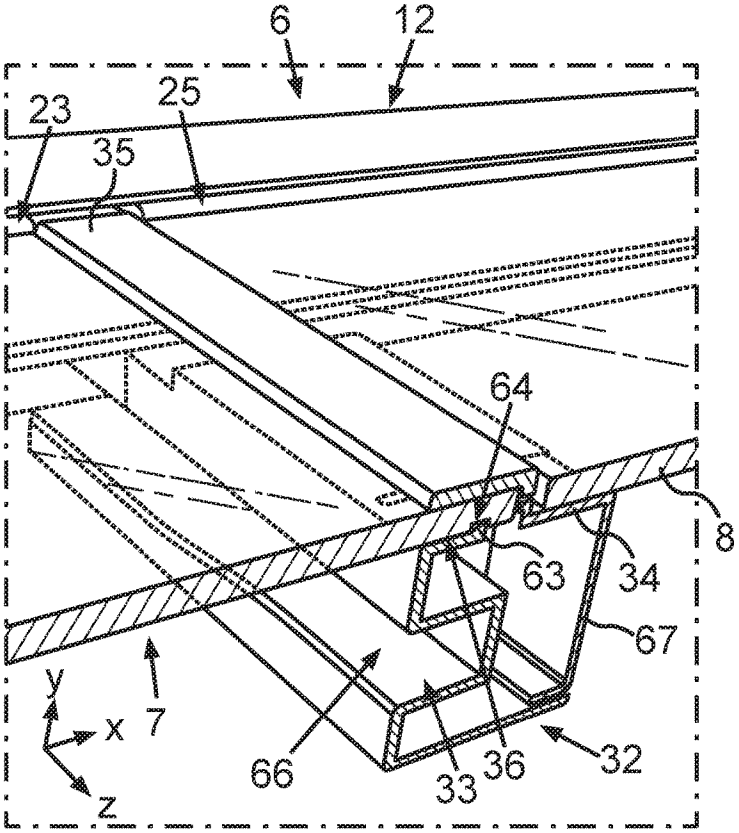
FIG. 10 is a perspective, vertical sectional view through the center web according to FIG. 9, also showing the two plate elements of the shelf plate.

FIG. 10 shows a vertical sectional view (sectional plane is the y-x plane) of the shelf 6 in the region of the center web 32 and through the snap-fit element 63. It can be seen that the center web 32 is hollow inside. In one advantageous embodiment the center web 32 can have a side cover 67 that closes off the side of the hollow region.

Figure 12:
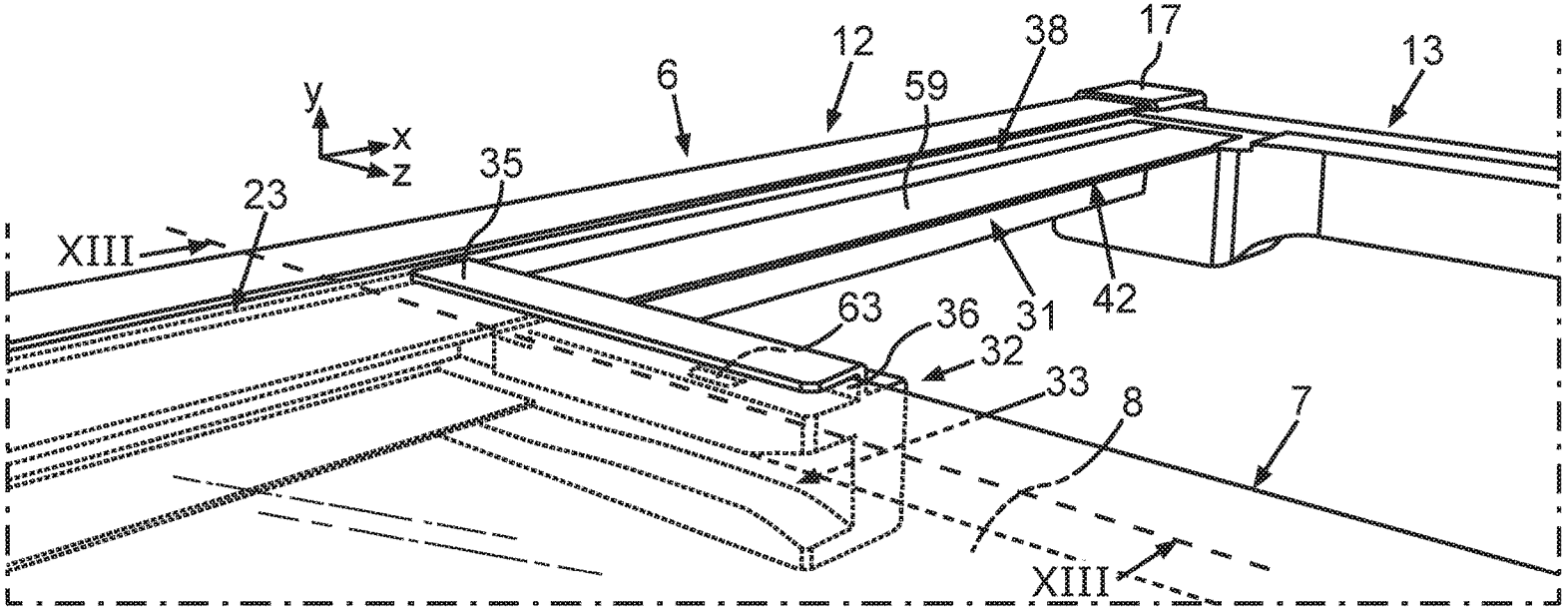
FIG. 12 is a perspective view of a further sub-region of the shelf.

FIG. 12 shows a perspective view of a sub-region of the shelf 6. It shows the stowage position or non-use position of the second plate element 8 below the first plate element 7.

Figure 13:
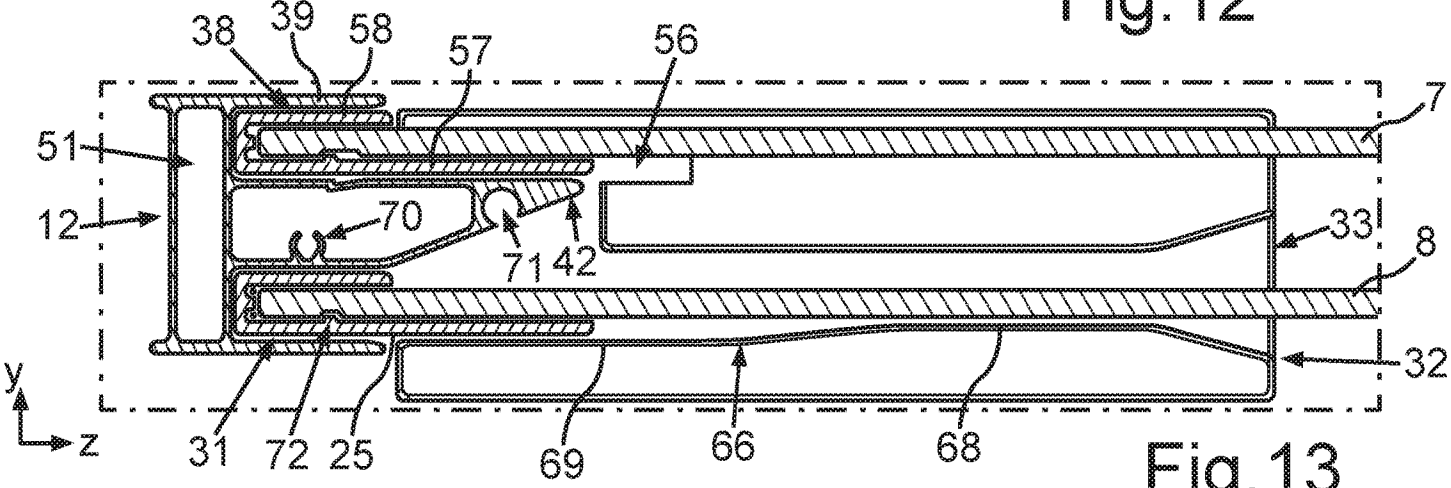
FIG. 13 is a vertical sectional view through the diagram according to FIG. 12.

FIG. 13 shows a vertical sectional view (sectional plane is the y-z plane) along the section line XIII-XIII in FIG. 12. The center web 32 is shown here in the uncut state. It can be seen from this view that the edge of the second plate element 8 is inserted into the holding groove 33. The non-flat embodiment of the lower boundary wall 66 means there is a base rise 68, on which the lower face of the second plate element 8 rests directly. A lowered region 69 of the lower boundary wall 66 is configured to the rear when viewed in a depthwise direction. This forms an air space for the edge protection element 25 when viewed in a heightwise direction. The second plate element 8 can therefore be supported flat in the holding groove 33. Further possible screw domes 70 and 71 are shown here. It can also be seen that a further snap-fit element 72 is configured on the edge protection element 25. This projects into a snap-fit holder 73 on the lower face of the plate element 8. This snaps the edge protection element 25 onto the second plate element 8. The same provision can be made with the edge protection element 23 to snap it onto the first plate element 7.

Figure 14:
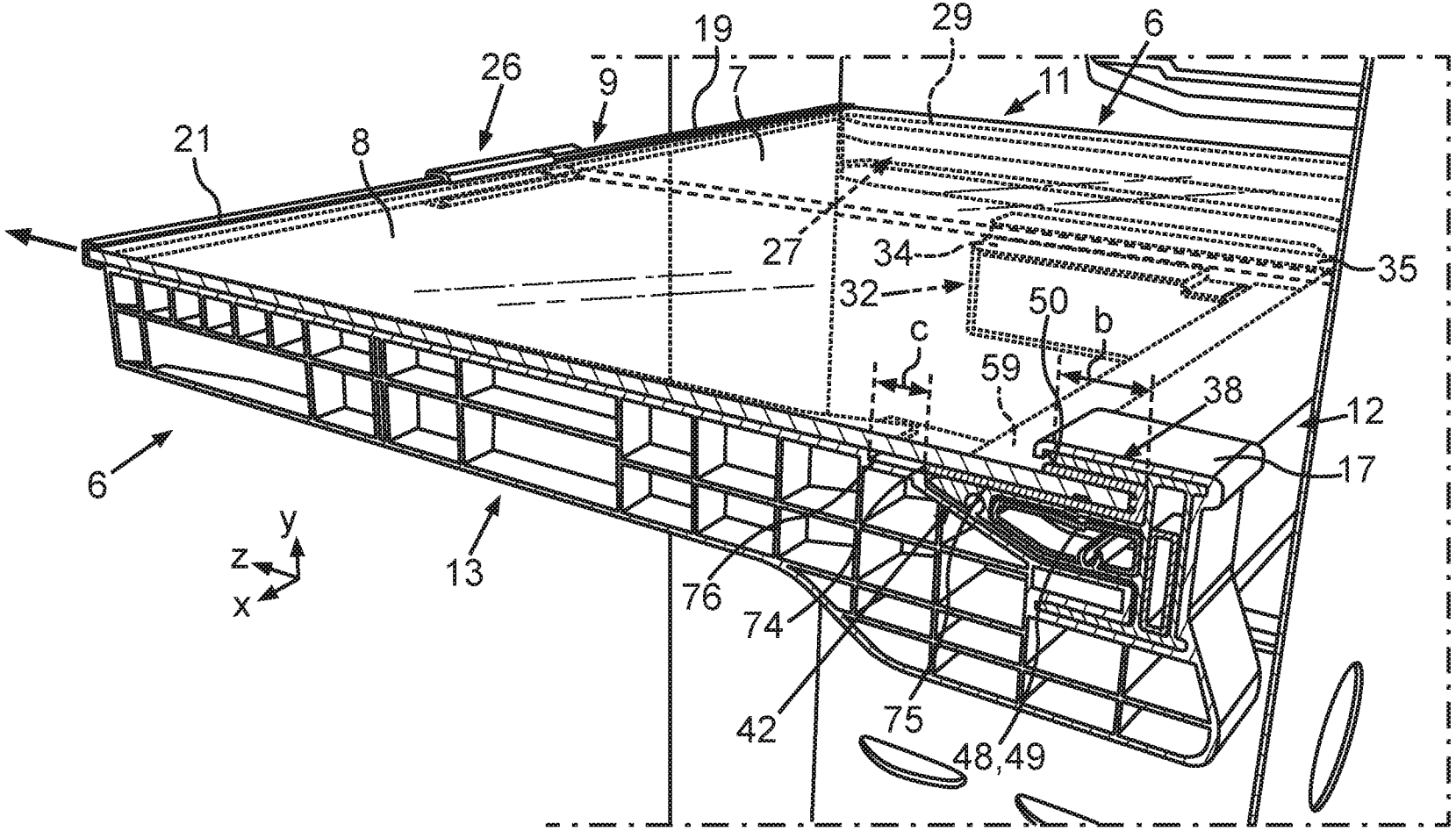
FIG. 14 is a perspective, sectional view through the shelf in the region of a second side frame element provided to hold the second plate element.

FIG. 14 shows a perspective sectional view of the shelf 6. The second side frame element 13 is shown in a vertical sectional view here, as is the second plate element 8. The two plate elements 7 and 8 are shown in a use position here. The end position of the second plate element 8 is shown. A depth b of the grooved holder 38 measured in a depthwise direction is shown. A distance c is also shown. The distance c is measured in a depthwise direction between a front edge 74 of a lower arm 75 of the edge protection element 25 and a stop edge forming a pull-out stop 76. The pull-out stop 76 is part of a stop integrated in the third frame element 13. The distance c is smaller than the depth b in the end position when the second plate element 8 is in the use position.

Figure 15:
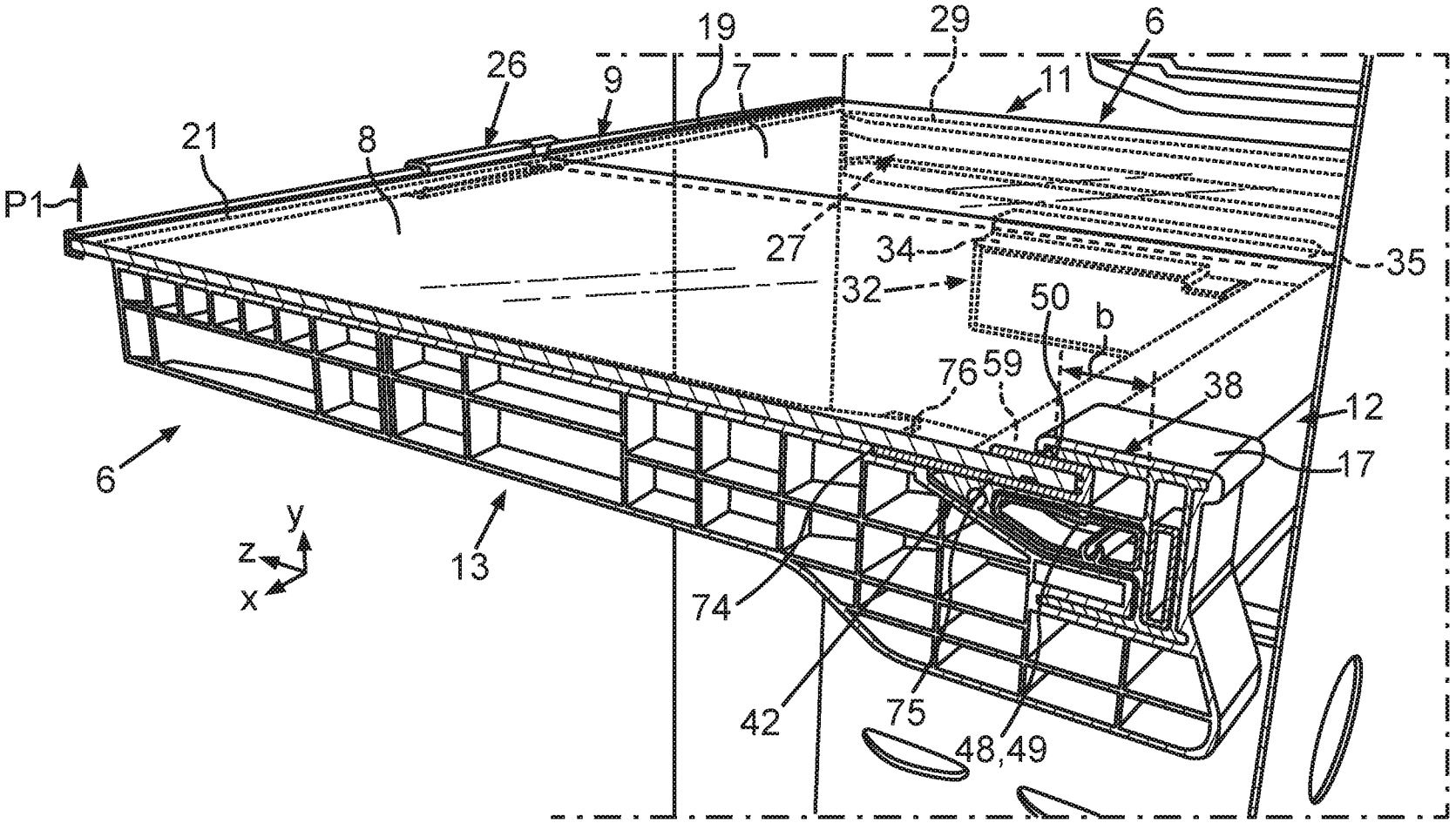
FIG. 15 is a perspective view according to FIG. 14, in which the second plate element is arranged in an intermediate removal position following on from the end position shown in FIG. 14.
Figure 16:
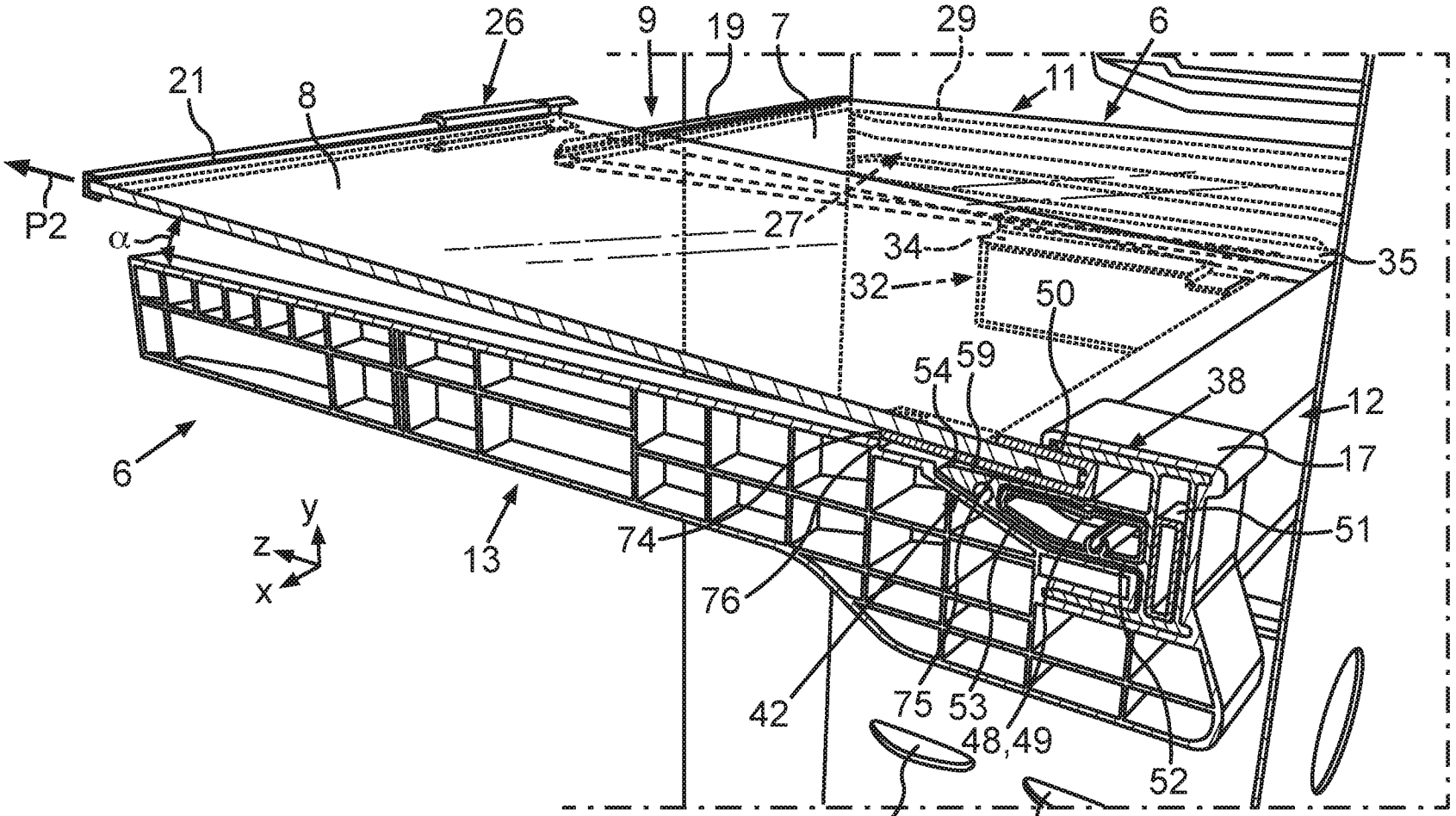
FIG. 16 is a perspective a view according to FIGS. 14 and 15, in which the second plate element is shown in a further intermediate removal position for removal, following on from the position in FIG. 15.

If the second plate element 8 is now moved out of its use position from the view in FIG. 14, in the view in FIG. 15 the second plate element 8 is first drawn forward in a linear manner in a positive z-direction. This results in an intermediate removal position according to FIG. 15. In this intermediate removal position the front edge 74 comes up against the pull-out stop 76. As the distance c in the view in FIG. 14 is greater than the overlap measured in a depthwise direction, in the intermediate removal position according to FIG. 15 the securing element 26 is decoupled from the first plate element 7. This means that the securing element 26 no longer overlaps with the first plate element 7 in a depthwise direction. In the intermediate removal position according to FIG. 15 however part of the rear region of the plate element 8 is still held in the grooved holder 38. This prevents the second plate element 8 dropping down in an unwanted manner. From the intermediate removal position shown in FIG. 15 the front edge of the second plate element 8 is raised, as shown by the arrow depiction P1 in FIG. 15, so that a further intermediate removal position is reached according to FIG. 16. A removal angle α is thus established. This is based on the surface offset 48 and the wall 49 and the tapering bevel at the front edge of the wall 39. In the position shown in FIG. 16 the second plate element 8 can be pulled out of the grooved holder 38 in the direction of the arrow P2. This allows the second plate element 8 to be removed from the shelf 6 completely, before it is stowed on the shelf 6 in the non-use position. In particular it is not possible to move the second plate element 8 from the use position to the non-use position or vice versa, without it not being released completely from the carrier frame 10. In particular the removal angle α results from the height of the pull-out stop 76 and the width of the lower arm 75 measured in a depthwise direction.

FIGS. 14 to 15 show the stacked structural parts of the rear frame element 12 on the one hand and the second side frame element 13 on the other hand. The screw domes are each shown without the screw elements.

Figure 17:
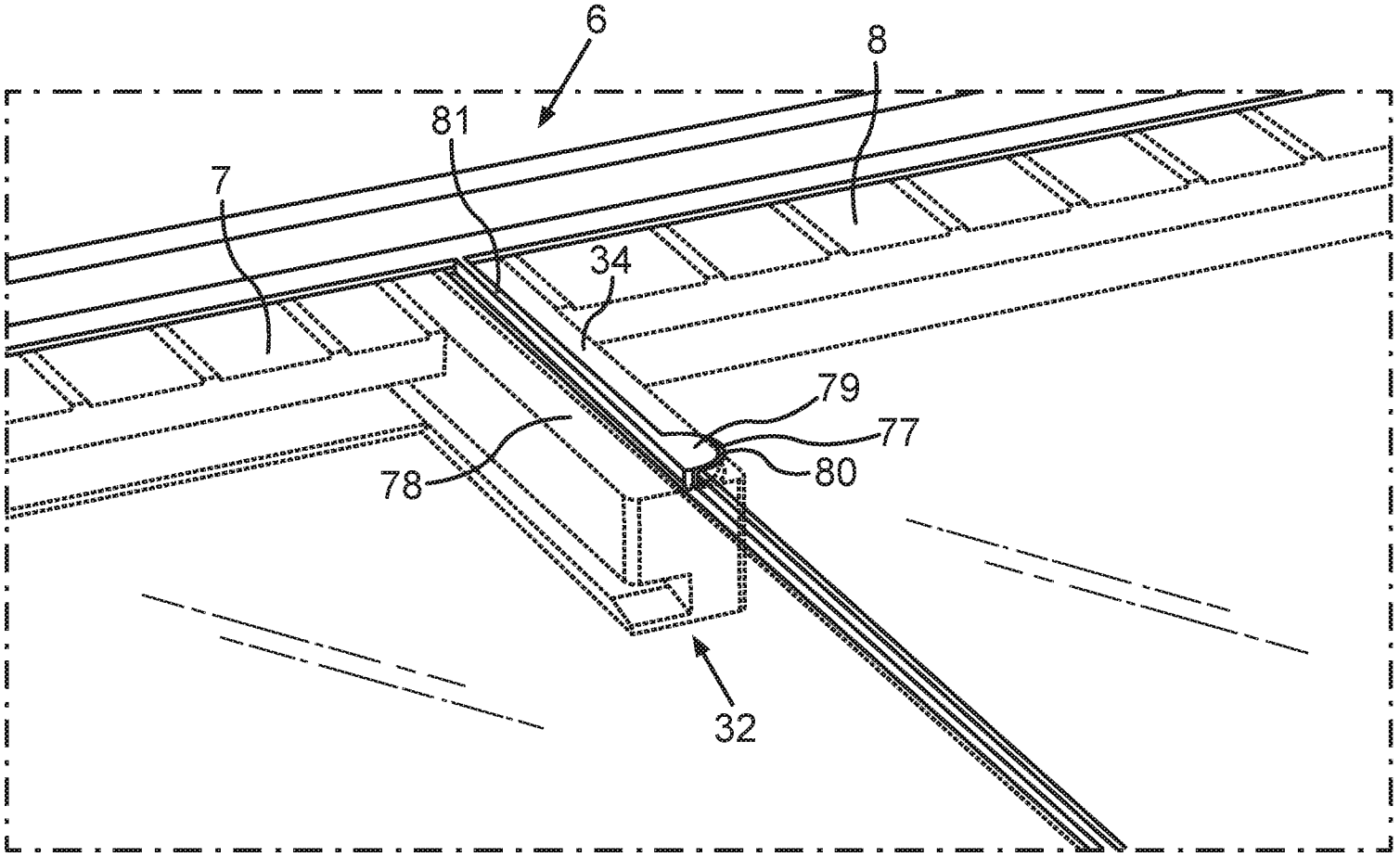
FIG. 17 is a perspective view of a partial detail of a further exemplary embodiment of a shelf.

FIG. 17 shows a further perspective view of a partial detail of a shelf 6. In this embodiment a center web 32 is provided which is configured differently from the embodiments cited above. With this embodiment the bearing plateau or bearing platform 34 is provided in the same manner. A further bearing platform 78 is provided for the first plate element 7. The bearing platform 78 is open at the top. There is therefore no groove 36. A pull-out protector of the second plate element 8 is also provided in a depthwise direction in the use position shown in FIG. 17. A corresponding rise 79 is configured to project upward. The bulge 77 can be a semicircular disk. This can be a bulge 77 formed in a widthwise direction according to the view in FIG. 17. This engages in a cut-out 80 on a side edge of the plate element 8. A web 81 oriented in a depthwise direction is also provided. This serves as an edge stop for both plate elements 7 and 8, when these are arranged in their use positions. With this embodiment the second plate element 8 can be removed from the end position shown in FIG. 17 by raising it at the front in a first step, so that the coupling between the elements 79 and 80 is decoupled. The resulting angled position allows the second plate element 8 to be removed in a forward direction.

Figure 18:
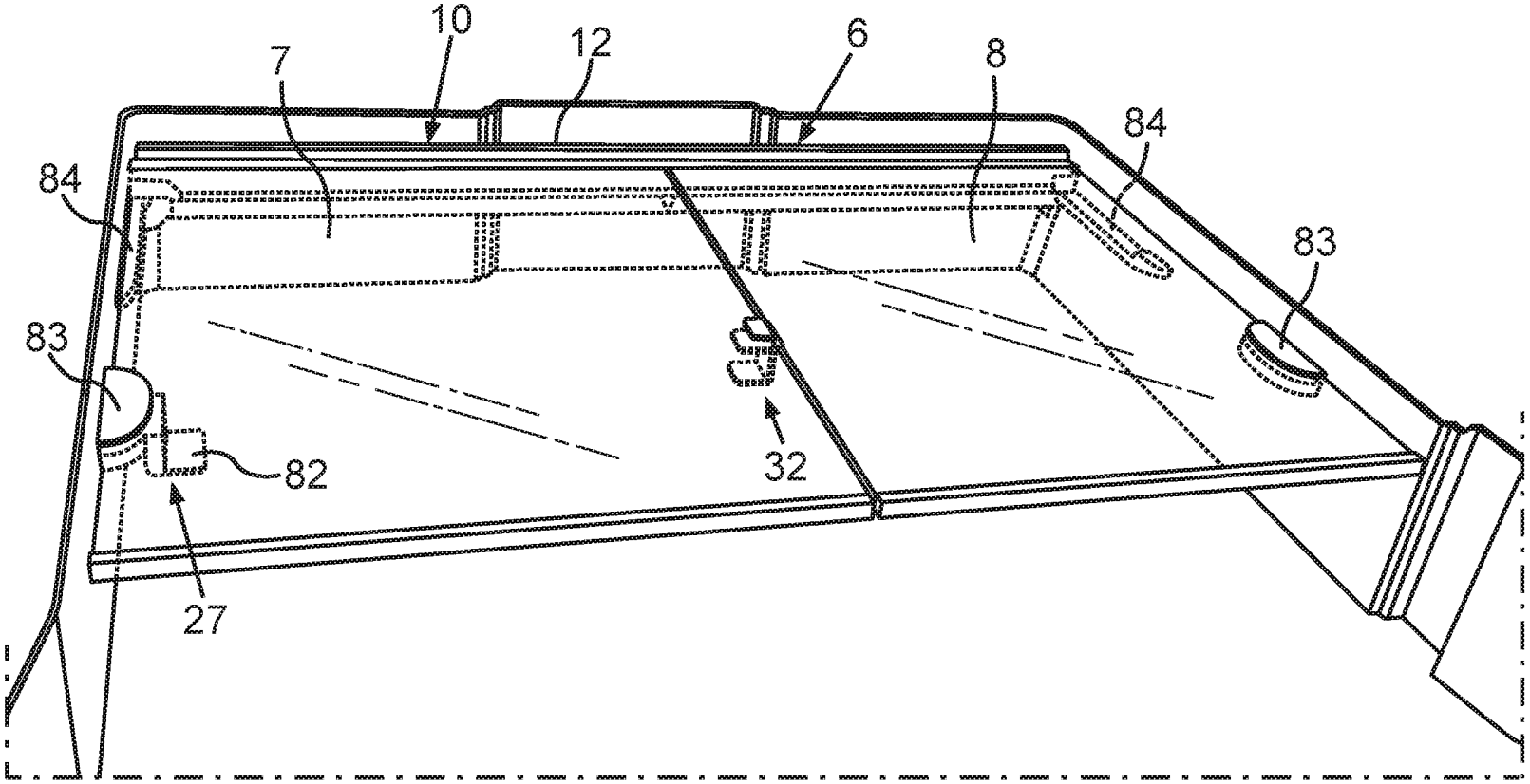
FIG. 18 is a perspective view of a further exemplary embodiment of a shelf.

FIG. 18 shows a perspective view of a further exemplary embodiment of a shelf 6. With this embodiment provision is made for the carrier frame 10 to have just one rear frame element 12. The side frame elements 11 and 13 are not present here. Separate parts 82 are provided here to configure a stowage unit 27. A center web 32 with a reduced length is also provided. The part 82 can be arranged on a cam 83, which is configured on a vertical side wall of the inner container 5. For example it can be attached thereto. Bearing platforms are formed in the center web 32 and the further element 82, it being possible to rest the second plate element 8 thereon in the non-use position. The center web 32 here is at a distance and decoupled from the rear frame element 12. A further cam 84 in particular is shown. This is also integrated in the inner container 5. The first plate element 7 rests on said cam 84 here. Cams 83 and/or 84 are configured in the same manner on the opposing side wall of the inner container.

Provision can generally be made for the carrier frame 10 to be made of plastic or metal. Provision can also be made for one frame element to be made of metal and another frame element to be made of plastic. For example the rear frame element 12 can be made of metal, in particular aluminum. An extruded aluminum profile can be used here.

The center web 32 can also be made of plastic or metal. In particular the securing element 26 can be dispensed with when the center web 32 is arranged relatively far forward. The carrier frame 10 can also be produced as a single piece part, for example an injection molded part.

The carrier frame 10 should be seen as a component that is only associated with the shelf 6. The carrier frame 10 therefore has no components that are molded as a single piece or fastened in a fixed position as cams or rails or the like on a vertical side wall or rear side wall of the inner container 5. Such components on an inner container serve as coupling structures, on or to which the shelf 6, in particular with its carrier frame 10, can be positioned and/or coupled. Such components of the inner container 5 that are separate from the shelf are shown for example by the cams 83 and 84 in FIG. 18. These are also shown by way of example in FIG. 3 and FIG. 16. The cams 83, 84 can also be configured differently.

A shelf 6 can also be provided as an accessory or retrofit part. It can therefore also be fitted to an existing household refrigeration appliance 1 at a later stage.

The following is a summary list of reference numerals and the corresponding structure used in the above description of the invention:

1 Household refrigeration appliance
2 Housing
3 Compartment
4 Door
5 Inner container
6 Shelf
7 Plate element
8 Plate element
9 Shelf plate
10 Carrier frame
11 Frame element
12 Frame element
13 Frame element
14 Corner region
15 Corner region
16 End plate

17 Cover plate
18 Front edge
19 Edge protection element
20 Front edge
21 Edge protection element
22 Rear edge
23 Edge protection element
24 Rear end
25 Edge protection element
26 Securing element
27 Stowage unit
28 Holding groove
29 Bearing platform
30 Stop web
31 Holding groove
32 Center web
33 Holding groove
34 Bearing platform
35 Retaining part
36 Groove
37*a* Cut-out
37*b* Cut-out
38 Grooved holder
39 Upper wall
40 Boundary wall
41 Upper wall
42 Separating web
43 Lower wall
44 Lower boundary wall
45 Hollow space
46 Screw dome
47 Drilled hole
48 Surface offset
49 Wall
50 Bevel
51 Hollow chamber
52 Segment
53 Segment
54 Bevel
55 Bevel
56 Holding trough
57 Lower arm
58 Upper arm
59 Bearing platform
60 Stop wall
61 Hollow region
62 Base
63 Snap-fit element
64 Snap-fit holder
65 Lower face
66 Lower boundary wall
67 Side cover
68 Base rise
69 Region
70 Screw dome
71 Screw dome
72 Snap-fit element
73 Snap-fit holder
74 Front edge
75 Lower arm
76 Pull-out stop
77 Bulge
78 Bearing platform
79 Rise
80 Cut-out
81 Web
82 Part
83 Cam
84 Cam
α Angle
a Overlap
b Depth
c Distance
x Widthwise direction
y Heightwise direction
z Depthwise direction
P1 Arrow depiction
P2 Arrow

The invention claimed is:

1. A shelf for a household refrigeration appliance, the shelf comprising:

a shelf plate having a first plate element and a separate second plate element disposed next to said first plate element in a widthwise direction of the shelf in a use position to form said shelf plate and said second plate element can be removed non-destructively to make said shelf plate smaller;

a carrier frame bordering edges of said shelf plate, said carrier frame is only configured around three sides of said shelf plate and having a rear frame element and two opposing side frame elements;

said rear frame element having a separating web oriented in a direction of a longitudinal axis of said rear frame element, said separating web separating an upper grooved holder formed in said rear frame element from a holding groove formed in said rear frame element and forming part of a stowage unit of the shelf, said holding groove configured below said upper grooved holder;

said upper grooved holder having an upper boundary wall;

said separating web having an upper wall forming a lower boundary wall of said upper grooved holder in a depthwise direction of the shelf and being larger than said upper boundary wall of said upper grooved holder, said upper wall of said separating web having a channel-shaped surface offset running in the widthwise direction of the shelf, at least in a segment in which said second plate element can be positioned, and configured at a point where said upper boundary wall of said upper grooved holder has its front edge in the depthwise direction of the shelf.

2. The shelf according to claim 1, wherein said rear frame element and said side frame elements are separate components, connected to one another in a releasable manner.

3. The shelf according to claim 1, wherein:

said first plate element has a rear edge;

said rear edge of said first plate element being inserted in said upper grooved holder; and/or one of said side frame elements has a bearing platform that is open at a top, and on which said first plate element rests.

4. The shelf according to claim 1, wherein one of said side frame elements has a side stop, against which a side edge of one of said first and second plate elements rests.

5. The shelf according to claim 1, wherein said rear frame element and one of said side frame elements together define said stowage unit, in which said second plate element can be stowed below said first plate element on the shelf in a non-use state.

6. The shelf according to claim 5, wherein said one side frame element has an integrated holding groove formed therein being part of said stowage unit.

7. The shelf according to claim 1, wherein said upper boundary wall of said upper grooved holder has a front edge region with an angled inner wall, thereby enlarging a vertical clearance of said upper grooved holder.

8. The shelf according to claim 1, wherein:

said side frame element has a pull-out stop configured thereon; and when viewed over an entire width of said second plate element measured in the widthwise direction, said upper grooved holder has a depth measured in the depthwise direction, which is greater than a distance, measured in the depthwise direction, between said pull-out stop configured on said side frame element, on which said second plate element can be disposed, and a front edge of an edge protection element.

9. The shelf according to claim 1, further comprising a securing element, which is disposed in a fixed position on a front edge of said second plate element, said securing element projecting beyond said second plate element in the widthwise direction, so that when said first and second plate elements are in the use position, said securing element engages around a front edge of said first plate element and holds said first and second two plate elements at a same height at a front.

10. The shelf according to claim 9, wherein an overlap measured in a depthwise direction between said securing element and said front edge is smaller than the depth of said upper grooved holder.

11. The shelf according to claim 1, further comprising plug-type connections and screw connections, said rear frame element and said side frame elements are separate components, connected to one another in a releasable manner by means of said plug-type connections and said screw connections.

12. The shelf according to claim 1, wherein said separating web has a lower wall that forms an upper boundary wall of said holding groove and is larger in a depthwise direction than a lower boundary wall of said holding groove.

13. The shelf according to claim 12, wherein said lower wall of said separating web has a straight rear segment and a second, front segment that rises obliquely upward and forward.

14. A shelf for a household refrigeration appliance, the shelf comprising:

a shelf plate having a first plate element and a separate second plate element disposed next to said first plate element in a widthwise direction of the shelf in a use position to form said shelf plate and said second plate element can be removed non-destructively to make said shelf plate smaller; and a carrier frame bordering edges of said shelf plate, said carrier frame is only configured around three sides of said shelf plate and having a rear frame element and two opposing side frame elements;

said rear frame element having a separating web oriented in a direction of a longitudinal axis of said rear frame element, said separating web separating an upper grooved holder formed in said rear frame element from a holding groove formed in said rear frame element and forming part of a stowage unit of the shelf, said holding groove configured below said upper grooved holder;

said separating web being configured as a hollow profile, in which screw domes are integrated at least for screwing said rear frame element to said side frame elements.

* * * * *